US006921180B2

(12) United States Patent
Huang

(10) Patent No.: US 6,921,180 B2
(45) Date of Patent: Jul. 26, 2005

(54) CONNECTOR OF A C-TYPE BULB ASSEMBLY

(76) Inventor: Ming-Hsien Huang, No. 2, Lane 65, Chen Kon Road, Hsinchu City (TW)

( * ) Notice: Subject to any disclaimer, the term of this patent is extended or adjusted under 35 U.S.C. 154(b) by 133 days.

(21) Appl. No.: 10/384,584

(22) Filed: Mar. 11, 2003

(65) Prior Publication Data

US 2004/0179356 A1 Sep. 16, 2004

(51) Int. Cl.[7] ..... F21L 4/02
(52) U.S. Cl. ..... 362/184; 362/226; 362/253
(58) Field of Search ..... 362/226, 253, 362/184; 439/419, 245

(56) References Cited

U.S. PATENT DOCUMENTS 6,022,241 A * 2/2000 Lin ..... 439/419
6,093,028 A * 7/2000 Yang ..... 439/13

* cited by examiner

*Primary Examiner*—Stephen Husar
*Assistant Examiner*—Anabel Ton
(74) *Attorney, Agent, or Firm*—Rosenberg, Klein & Lee

(57) ABSTRACT

The present invention relates to a connector of a C-type bulb assembly which includes two half symmetric pieces, wherein the first piece having its two side projections provided with related rods and the second piece having its two side projections provided with related apertures. The two half pieces can be assembled together to become the connector while the bulb holder is connected therein, and the holder with the connector is capable of being assembled or disassembled with the shell easily and quickly.

3 Claims, 6 Drawing Sheets

CONNECTOR OF A C-TYPE BULB ASSEMBLY

BACKGROUND OF THE INVENTION

A conventional C-type Bulb Assembly includes a bulb holder (2) with a bulb and a shell (3). As shown in FIG. 1, the holder (2) provided with a metal elastic piece (1) is received in the shell (3), wherein the elastic piece (1) engages with inner end of the shell for secure connection. In use, the bulb holder (2) is hard to be disassembled from the shell (3) after the elastic piece (1) is engaged therein. And the known C-type bulb assembly can not be used outdoors because the metal piece (1) may occur electrical leakage.

Accordingly, the present invention provides a new C-type bulb assembly, which includes a connector to connect with the bulb holder to make the holder be assembled or disassembled with the shell easily and quickly.

BRIEF DESCRIPTION OF THE DRAWINGS

Now the features and advantages of the present invention will be describes in detail with reference to the accompanying drawings.

DETAILED DESCRIPTION OF THE INVENTION

Figure 1:
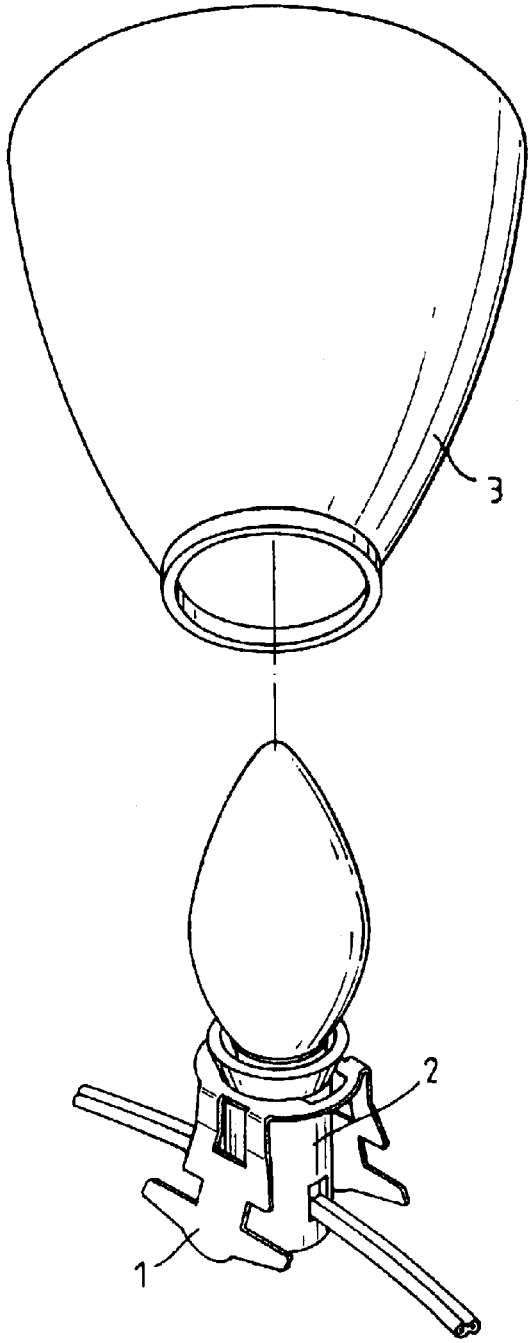
FIG. 1 (prior art)
FIG. 1 is a perspective view showing a conventional C-type bulb assembly.
Figure 2:
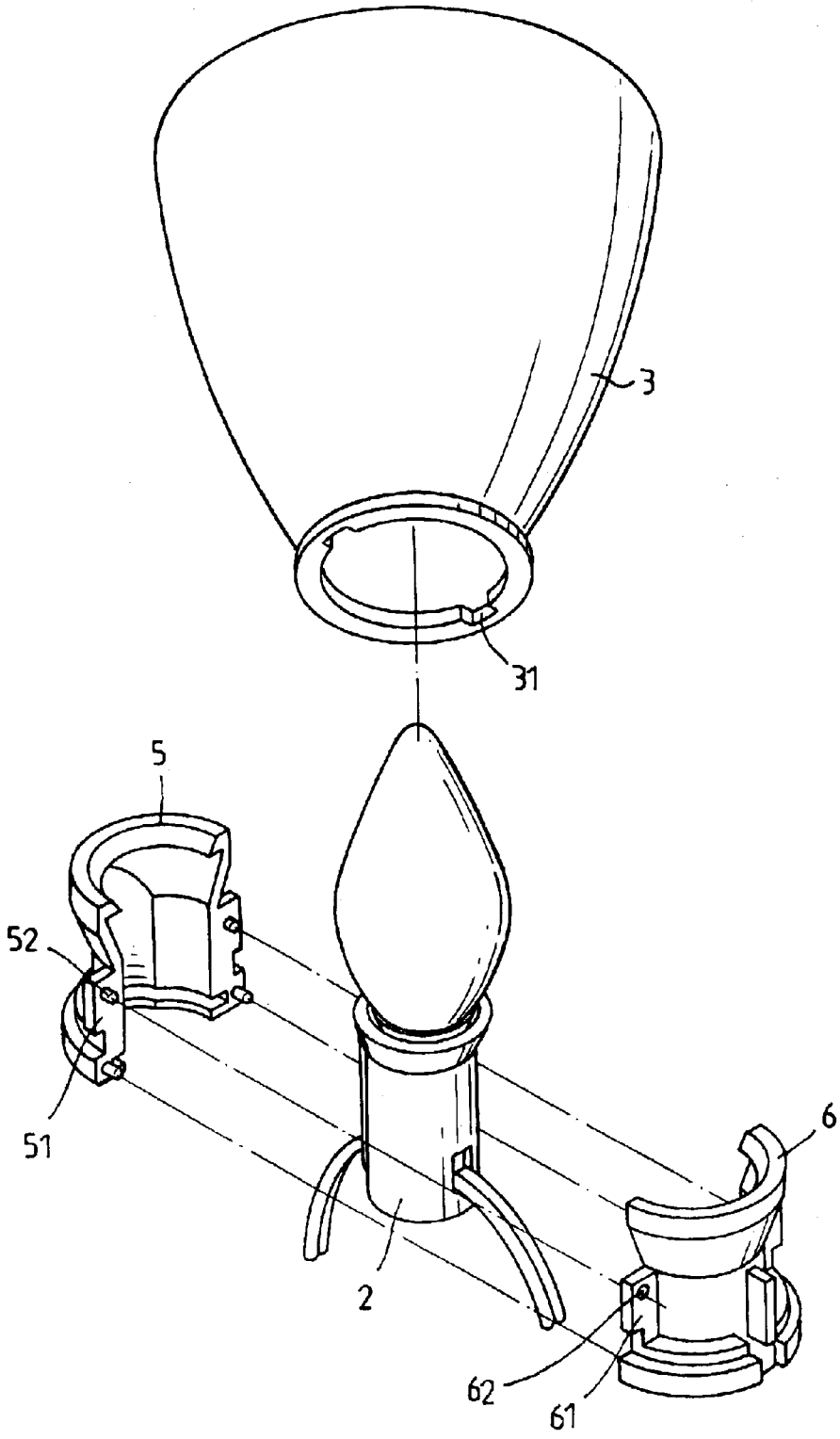
FIG. 2 is a perspective view showing a C-type bulb assembly with a connector before assembling according to the present invention.
Figure 3:
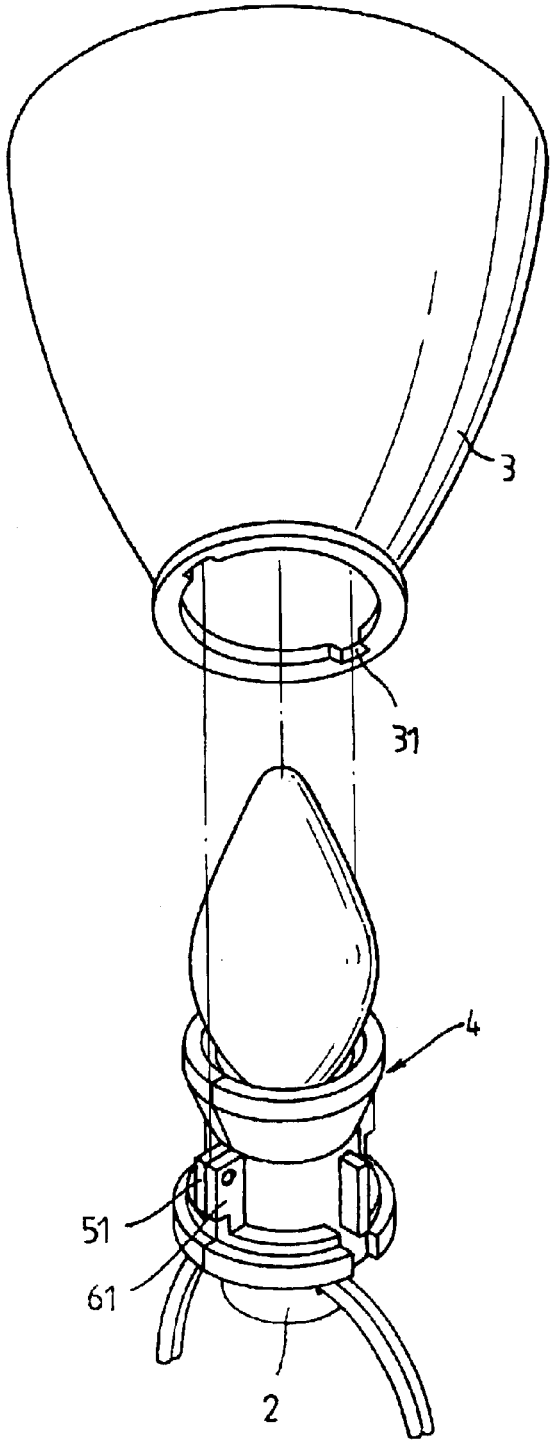
FIG. 3 shows a perspective view of FIG. 2 after the connector is assembled on the holder.
Figure 4:
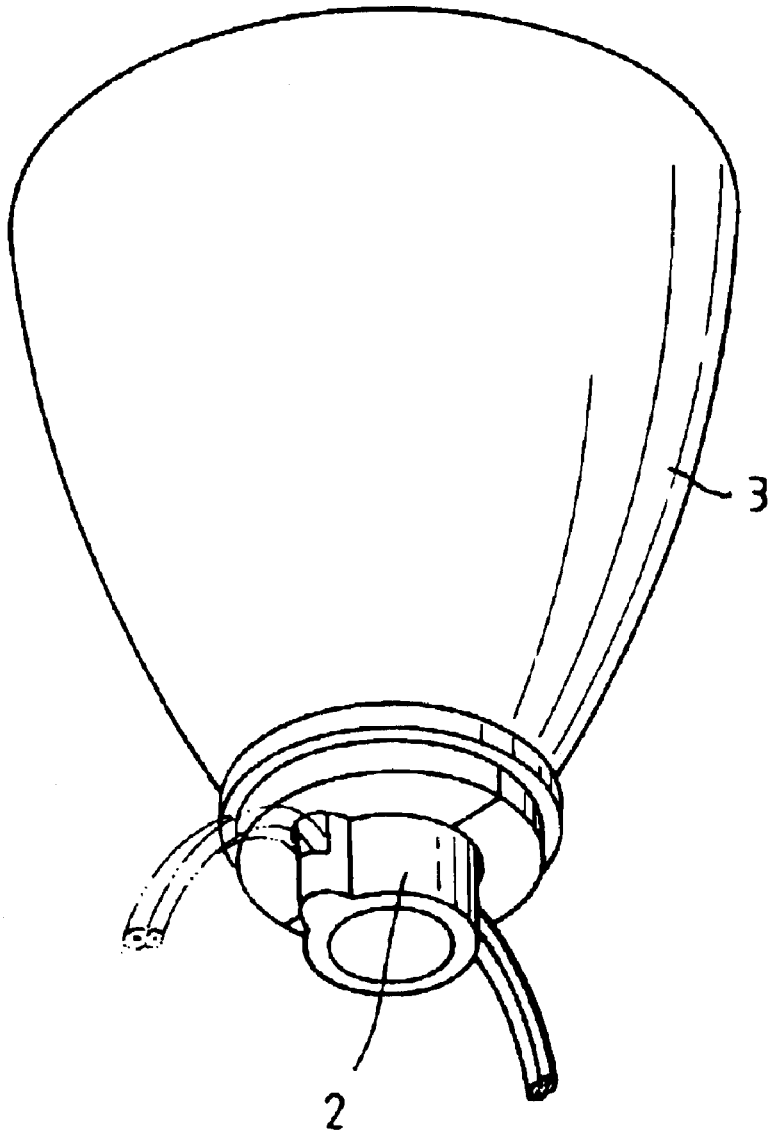
FIG. 4 is a perspective view showing an assembled C-type bulb assembly according to the present invention.

Please firstly referring to FIG. 2 to 4, the present invention relates to an improved connector (4) for assembling a bulb holder (2) and a shell (3) of a C-type bulb assembly. The connector (4) is composed of two symmetric half piece (5), (6), wherein the first half piece (5) has its two side projections (51) provided with related rod (52) and the second half piece (6) has its two side projections (61) provided with related aperture (62). Hence, the two half pieces (5), (6) can be combined together to become the connector (4) while the holder (2) is connected therein by use of the easy engagement between the rod (52) and the aperture (62). The shell (3) has its connecting end provided with two side grooves (31). The bulb holder (2) with the connector (4) can be received in the shell (3) as the projections (51), (61) passing through the grooves (31) without difficulty. And after the holder (2) is rotated a small angle, it will be then assembled with the shell (3) in secure. Under this structure, it can be understood that it is also very easy to disassemble the holder (2) with the connector (4) from the shell (3) by rotating the holder (2) reversely.

Figure 5:
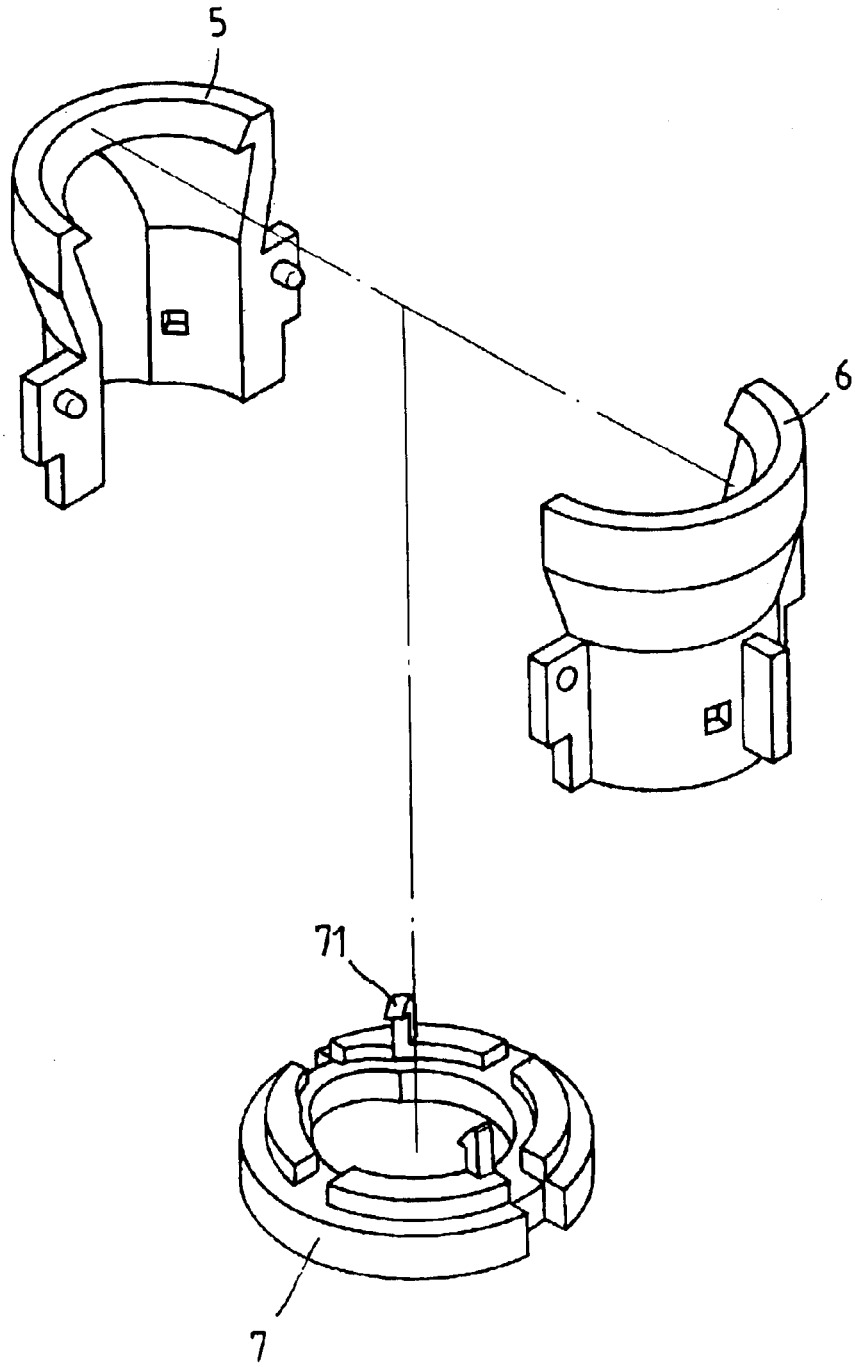
FIG. 5 is an exploded perspective view showing a modified embodiment of the connector according to the present invention.
Figure 6:
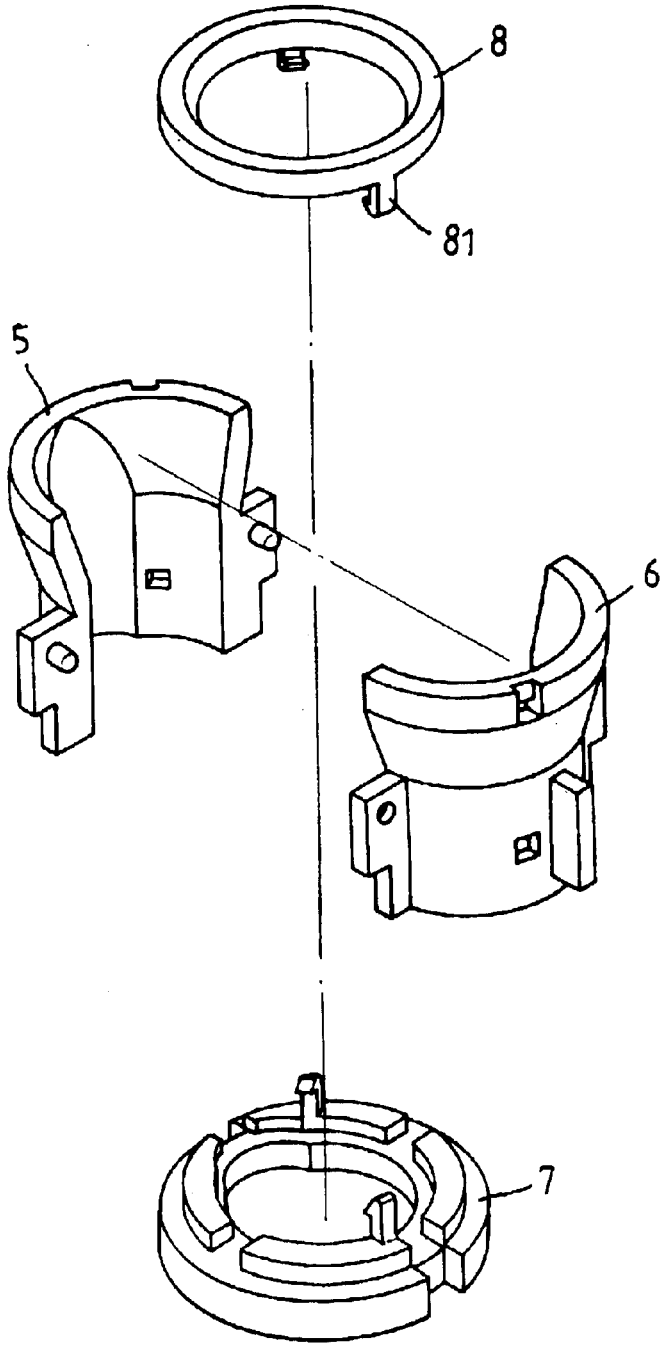
FIG. 6 is an exploded perspective view showing another modified embodiment of the connector according to the present invention.

In FIG. 5, it shows a modified embodiment, which includes a connector (4) consisted of two symmetric half pieces (5), (6) and a bottom ring base (7) including upward hooks (71) to connect with related apertures on the connector (4). As shown in FIG. 6, it is another modified embodiment, which includes an upper ring (8) with downward hooks (81) for connecting with the connector (4). The modified embodiments can provide the same effect for assembling the C-type bulb assembly and can be manufactured more conveniently.

What is claimed is:

1. A connector of a C-type bulb assembly including two half symnietric pieces, wherein the first piece has two side projections provided with related rods and the second piece has two side projections provided with related apertures, the two half pieces being assembled together to become the connector while the bulb holder is connected therein, and the holder with the connector being capable of assembling or disassembling with the shell in ease, wherein said two side projections of said first piece and said two side projections of said second piece form a pair of locking members, said pair of locking members being removably received within a corresponding pair of side grooves formed in a lower periphery of said shell in order to releasably lock said shell to said connector.

2. The connector of a C-type bulb assembly as claimed in claim 1, wherein the connector is consisted of two symmetric half pieces and a bottom ring base having upward hooks to connect with apertures of the connector.

3. The connector of a C-type bulb assembly as claimed in claim 1, wherein the connector is consisted of two symmetric half pieces, a bottom ring base having upward hooks and an upper ring having downward hooks to connect with apertures of the connector.

* * * * *